United States Patent [19]

Ferris et al.

[11] 4,054,946

[45] Oct. 18, 1977

[54] ELECTRON SOURCE OF A SINGLE CRYSTAL OF LANTHANUM HEXABORIDE EMITTING SURFACE OF (110) CRYSTAL PLANE

[75] Inventors: Stephen Duncan Ferris, Warren; David Charles Joy, Summit; Harry John Leamy, New Providence; Louis David Longinotti, South Plainfield; Paul Herman Schmidt, Chatham, all of N.J.

[73] Assignee: Bell Telephone Laboratories, Incorporated, Murray Hill, N.J.

[21] Appl. No.: 727,466

[22] Filed: Sept. 28, 1976

[51] Int. Cl.[2] ..... H01J 1/14; H01J 19/06; H01K 1/04

[52] U.S. Cl. ..... 313/346 R; 252/509; 252/521; 313/336

[58] Field of Search ..... 313/336, 346; 252/509, 252/518, 521

[56] References Cited

U.S. PATENT DOCUMENTS

| | | | |
|---|---|---|---|
| 3,312,856 | 4/1967 | Lafferty et al. | 313/346 R |
| 3,462,635 | 8/1969 | Broers | 313/346 R |
| 3,631,291 | 12/1971 | Favreav | 313/346 R |
| 3,823,337 | 7/1974 | VanStratum et al. | 313/346 R |
| 3,833,494 | 9/1974 | VanStratum et al. | 313/346 R |
| 3,928,783 | 12/1975 | Hosoki et al. | 313/346 R |
| 3,932,314 | 1/1976 | Kawabe et al. | 313/346 R |
| 3,944,866 | 3/1976 | Sayer | 313/346 R |

*Primary Examiner*—Saxfield Chatmon, Jr.
*Attorney, Agent, or Firm*—George S. Indig

[57] ABSTRACT

An electron source using a single lanthanum hexaboride crystal oriented so the emitting surface is defined by a {110} crystal plane.

5 Claims, 2 Drawing Figures

ELECTRON SOURCE OF A SINGLE CRYSTAL OF LANTHANUM HEXABORIDE EMITTING SURFACE OF (110) CRYSTAL PLANE

BACKGROUND OF THE INVENTION

1. Field of the Invention

This invention relates generally to electron emitting materials and more particularly, it relates to single crystal lanthanum hexaboride electron emitters.

2. Description of the Prior Art

Many modern instruments, such as scanning electron microscopes and electron beam exposure systems, require small but bright and dimensionally stable electron sources. The cathode material used as a source of electron beams has usually been either tungsten or thoriated tungsten. Both materials are relatively bright and sources fabricated from these materials have reasonable lifetimes and have performed well. However, as the capacity demanded of these instruments has increased, other cathode materials with longer lifetimes have been sought.

Since the publication by Lafferty, *Journal of Applied Physics*, 22, pp. 299–309, March 1951, of an article describing the thermionic emission properties of alkaline and rare-earth borides having the chemical formula $MB_6$, where M represents an alkaline or rare-earth element, and of cubic crystal structure, much effort has been expended investigating the use of $LaB_6$ as a electron source. This material appears potentially more useful than tungsten or thoriated tungsten because its high melting temperature, low vapor pressure and small work function afford possibilities of lower operating temperatures and longer lifetimes. The lower temperature would alleviate problems of dimensional instability caused by thermal expansion or drift. Measured values for the work function of $LaB_6$ cluster around 2.7 volts. This compares to 4.5 volts usually reported for tungsten. There is a wide range of emission values reported for tungsten and $LaB_6$, and this variation is usually attributed to surface impurities, non-stoichiometry and the effect of averaging over several crystal planes in polycrystalline cathodes.

Several reports have been published, *Applied Physics Letters* 27, pp. 113–114, Aug. 1, 1975, and *Applied Physics Letters* 28, pp. 578–580, May 15, 1976, reporting use of $LaB_6$ single crystals as cathode materials. Due to the ease of growing and mounting the $LaB_6$ single crystals along the <100> direction, only that direction and directions approximating that growth direction have been previously investigated.

Other problems, not completely solved by the prior art, that must be overcome before $LaB_6$ cathodes can be extensively used include chemical compatibility of the cathode with the structural mounting apparatus and dimensional stability of the crystal and mounting apparatus.

SUMMARY OF THE INVENTION

An electron emission device has a single crystal lanthanum hexaboride electron emitter oriented with its emitting face defined by a {110} crystal plane. Suitable embodiments for support members are also described.

DETAILED DESCRIPTION

Figure 1:
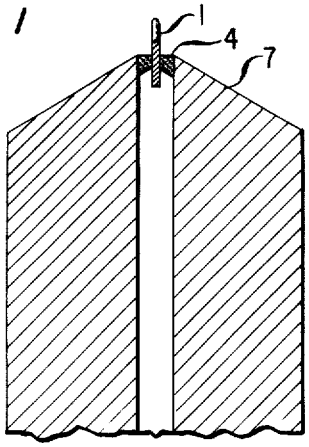
FIG. 1 is a cross-sectional view of an $LaB_6$ single crystal and mounting structure.

It has been found that the intensity of electron emission from $LaB_6$ single crystals is strongly anisotropic with the direction of maximum intensity corresponding to the normal to the planes substantially defining the {110} crystal planes.

The $LaB_6$ crystal may be grown by conventional crystal growing techniques such as direct combination, e.g., arc synthesis, Czochralski growth, arc zone melting or a flux technique, e.g., Al. The first method yields a polycrystalline sample from which a single crystal may be cut. Czochralski growth is a well known technique and will not be described further. Arc zone melting is described by Gibson and Verhoeven, *Journal of Physics* E 8, pp. 1003–1004 (1975). The Al flux growth technique is outlined in *Japan J. App. Phys.* 13, p. 391 (1974) and will be discussed in some detail.

The starting materials were of high purity, desirably greater than 95 percent by weight, and consisted of 90–98 percent by weight Al and 10–2 percent by weight of arc synthesized or a stoichiometric elemental mixture of $LaB_6$. The mixture was heated to 1450° C, although any temperature within the range from 1200°–1600° C may be used, for a time period that may vary from several minutes to several days depending upon the amount of starting material dissolved in the solvent and then slowly cooled to room temperature over a period from several hours to several days. During cooling, the $LaB_6$ precipitates as single crystals. After cooling the Al solvent may be removed with either HCl or NaOH.

The crystals are desirably used as grown, i.e., with natural facets rather than being mechanically shaped. Mechanical shaping is desirably avoided because it might possibly introduce crystal defects which degrade the intensity of electron emission. Naturally faceted single crystal prisms obtained in this manner have typical dimensions of $0.1 \times 0.1 \times 5$–7 mm. It has been found advantageous to further shape the crystal tip electrolytically using a electrolyte composed of 80% $H_2O$ and 20% HCl. The bath was maintained at room temperature and a DC potential of 10 volts applied using a tantalum cathode although any nonreactive metal can be used. The crystal tips are shaped in approximately 15 seconds and have an included angle of approximately 60° with a 1–2 μm radius tip that is approximately hemispherical. Although the single crystals may be used without shaping, shaping has been found desirable as it reduces the effective size of the emitter.

The single crystal $LaB_6$ cathode is useful over the approximate temperature range extending from 900° C to 1700° C with the interval between 1265° C and 1350° C having been found optimum. Below 1265° C, the tip may not be completely activated and may be unstable. Above 1350° C, the rate of increase of brightness with temperature decreases. Below 900° C, electron emission is too low to yield useful current densities and above 1700° C, sublimation from the crystal tip significantly reduces, and probably constitutes the ultimate limitation on, emitter lifetime. By way of comparison a typical operating temperature for a tungsten cathode is 2600° K. It has been found during normal operation that sublimation does not affect emitter performance.

The emitter typically operates at a pressure less than $10^{-6}$ Torr. Greater pressures reduce emitter lifetime because a chemical reaction between $O_2$ or water vapor, and B, in the crystal, causes the formation of $B_2O_3$ which, having a high vapor pressure, readily vaporizes. Arcing between the tip and the anode plate, because of the high electric field at the tip, occurs at pressures greater than $10^{-5}$ Torr.

Measured activation temperatures were approximately 1275° C, although it was found that the operating temperature could be reduced after activation and an adequate current density maintained. It is believed that the high activation temperature causes evaporation from the emitter surface of contaminants that inhibit electron emission.

Dimensional stability being essential for successful operation of an $LaB_6$ electron source, a structure applicants have found suitable and depicted in FIG. 1 will be described. $LaB_6$ single crystal 1 is held between two pieces of vitreous carbon 4 which, in turn, are supported by molybdenum jaws 7. The entire unit may be made interchangeable with conventional tungsten hairpin filaments. The structure and materials overcome the problems of chemical reactivity of $LaB_6$ with the supporting material at high temperatures and dimensional instabilities arising from thermal expansion of the mounting structure causing the crystal to move. For the resistively heated crystal depicted (the current source is not shown), vitreous carbon has been found better than the pyrolytic carbon previously used because its poorer thermal conductivity permits the desired crystal temperature to be reached with a smaller current and therefore less heat is dissipated in the mounting structure. The relatively high thermal conductivity of the molybdenum jaws, compared to previously used materials, further improves the dimensional stability by decreasing the thermal expansion of the jaws. Although the particular structure described has molybdenum jaws, any metal, such as tantalum, having similar thermal characteristics may be used to the same advantage.

Electron current measurements were made in an ion pumped vacuum chamber at a pressure of approximately $5 \times 10^{-7}$ Torr. The measuring apparatus included a standard Faraday cup electron collector and picoammeter, an accelerating anode plate formed from tantalum and having a 1.0 mm aperture together with the mounting structure described. For test purposes, the mounting structure was made rotatable, in one plane, plus or minus 50°, with the axis of rotation passing directly through the crystal tip. Deflector plates, mounted between the anode and Faraday cup, aided beam alignment.

Figure 2:
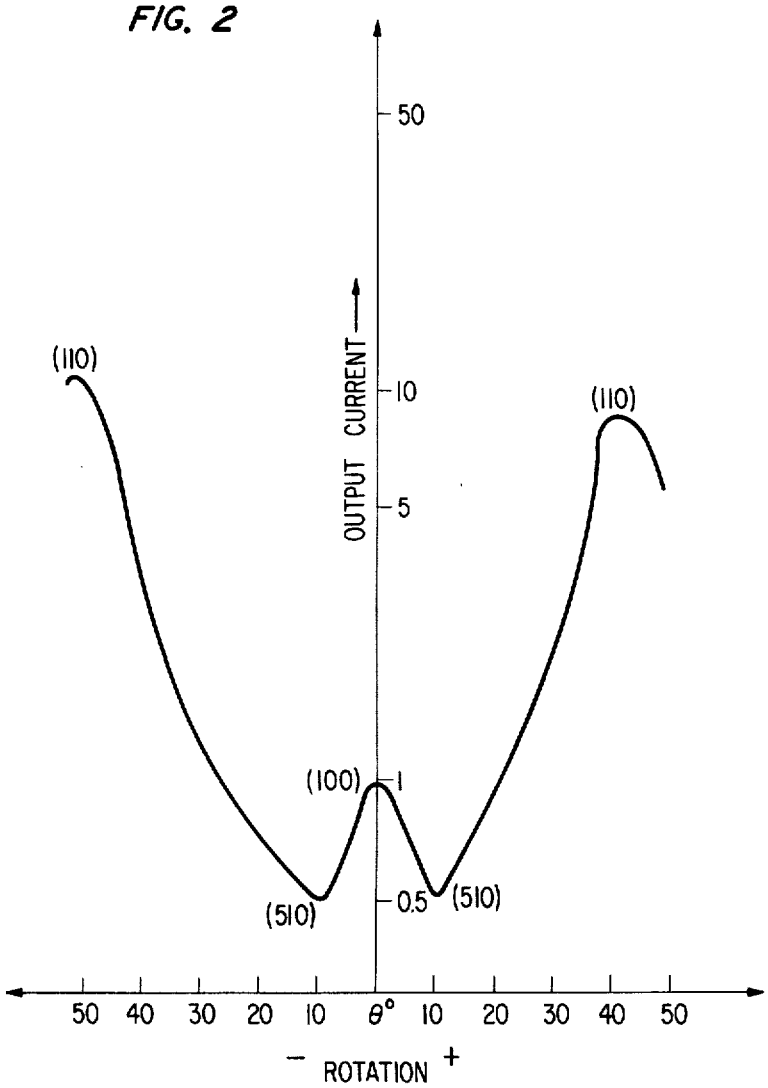
FIG. 2 is a graph showing the electron output (arbitrary units) versus the angle of rotation about an axis normal to the <100> crystal direction.

FIG. 2 shows output current from the Faraday cup in arbitrary units, versus the angle of rotation about an axis normal to a <100> crystal direction and which passes through the crystal tip. The temperature was 1545° K as measured with a calibrated pyrometer and the power was approximately 2 watts (1½ amps at 1½ volts). As can be seen, the electron current is approximately 10 times greater for the <110> crystal directions, i.e., for an emitter surface defined by a {110} crystal plane, than for the <100> crystal direction. Measured current densities in the direction of maximum emission were in excess of 10 amps/cm². Maximum electron currents in the <110> direction were obtained at a temperature slightly in excess of 1600° K. Experimentally observed emitter lifetimes were in excess of 300 hours at an operating temperature of 1300° C.

What is claimed is:

1. An electron emission device comprising a lanthanum hexaboride single crystal characterized in that the emitting surface of said single crystal is defined by a {110} crystal plane.

2. An electron emission device as recited in claim 1 wherein said single crystal is used in a thermionic emission cathode.

3. An electron emission device as recited in claim 1 comprising vitreous carbon pieces, said pieces holding said single crystal.

4. An electron emission device as recited in claim 1 comprising molybdenum jaws, said jaws supporting said vitreous pieces.

5. An electron emission device as recited in claim 1 in which said single crystal is electrolytically shaped.

* * * * *